US005688071A

United States Patent [19]

Owen

[11] Patent Number: 5,688,071

[45] Date of Patent: Nov. 18, 1997

[54] ROAD ELEMENTS, AND METHOD OF AND DEVICE FOR TRANSFERRING SAME

[76] Inventor: Alfred W. Owen, P.O. Box 99337, Raleigh, N.C. 27624-9337

[21] Appl. No.: 653,866

[22] Filed: May 28, 1996

[51] Int. Cl.[6] ..... E01F 13/04

[52] U.S. Cl. ..... 404/6; 256/13.1

[58] Field of Search ..... 404/1, 6, 7, 9; 256/1, 13.1; 280/504, 514, 515; 104/89, 91, 93, 94, 95

[56] References Cited

U.S. PATENT DOCUMENTS

| | | | |
|---|---|---|---|
| 2,535,468 | 12/1950 | Von Bank | 280/504 |
| 4,498,803 | 2/1985 | Quittner | 404/6 |
| 4,806,044 | 2/1989 | Duckett | 404/6 |
| 4,815,889 | 3/1989 | Duckett | 256/13.1 X |
| 4,828,425 | 5/1989 | Duckett | 404/6 |
| 5,074,704 | 12/1991 | McKay | 404/6 |

*Primary Examiner*—James Lisehora
*Attorney, Agent, or Firm*—Ilya Zborovsky

[57] ABSTRACT

A method of transferring a plurality of road elements includes the steps of arranging a plurality of roller units on each of the road elements substantially centrally of each road element, pivotally connecting end portions of the adjacent road elements with one another, engaging the roller units of the road elements by a guiding element having a channel shape and two ends spaced from one another in a longitudinal direction and in a transverse direction, so that the roller units guidingly move inside the guiding element along the guiding element from one of the ends to the other of the ends and at the same time slightly pivot relative to one another, so that the road elements are transferred from a location at one end of the guiding element to the location at the other end of the guiding element.

8 Claims, 6 Drawing Sheets

ROAD ELEMENTS, AND METHOD OF AND DEVICE FOR TRANSFERRING SAME

BACKGROUND OF THE INVENTION

The present invention relates generally to road elements and to a method of and a device for transferring the road elements.

Road elements, such as for example movable modular elements, are used to form partitions between tracks on roadways, to form narrowing of the roadway, to protect working personnel on the roadway, etc.

Methods and devices for transferring the barriers are known in the art. Some of such methods and devices are disclosed in U.S. Pat. Nos. 2,931,279, 4,624,601, 4,500,225, 4,498,803, 4,955,753 and 5,074,704, as well as Canadian Patent 1,208,469. The methods and devices disclosed in these references, as well as the road elements disclosed in these references, can be further improved.

SUMMARY OF THE INVENTION

It is therefore an object of the present invention to provide the road elements, as well as a method of and a device for transferring the road elements, which avoid the disadvantages of the prior art.

In keeping with these objects and with others which will become apparent hereinafter, one feature of the present invention resides, briefly stated, in road elements which are formed so that each of the road elements has a roller unit arranged substantially in a center of the road element between its ends, the adjacent ends of two neighboring road elements are pivotally connected to one another, for example, by plates, etc., so that during transferring of the road elements by means of, for example, a channel-shaped guiding, element, the roller units of the road elements rotate inside the guiding element, while the road elements turn relative to one another during the transfer.

It is also an object of the present invention to provide a method of and a device for transferring a plurality of the above-mentioned road elements, which include the steps and the structural elements corresponding to the structural elements of the road elements. In particular, the transferring of the road elements is performed by engaging the roller units located in the center of the road elements by a channel-like guiding element and displacing the guiding element so that the road elements turn relative to one another in the region of the pivotal connection of their ends while the roller units roll inside the guiding element, and the road elements are transferred from one location to another location.

When the road elements, the method and the device, are formed in accordance with the present invention, it further improves the existing road elements, methods and devices.

DESCRIPTION OF PREFERRED EMBODIMENTS

Figures 1, 2:
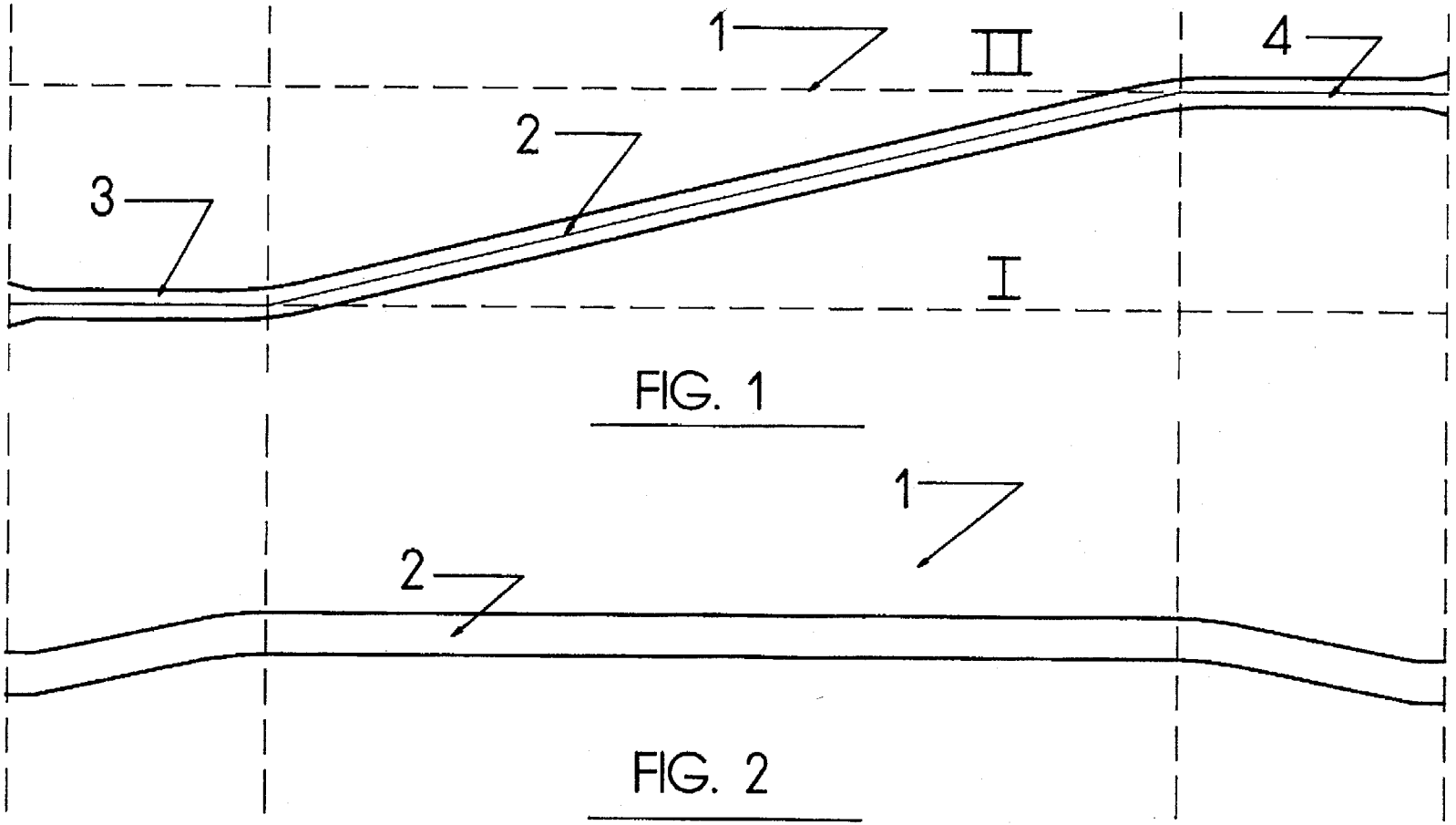
FIG. 1 is a plan view schematically showing a method of and a device for transporting a plurality of road elements in accordance with the present invention.
FIG. 2 is a side view of the guiding element of the device in accordance with the present invention.
Figure 3:
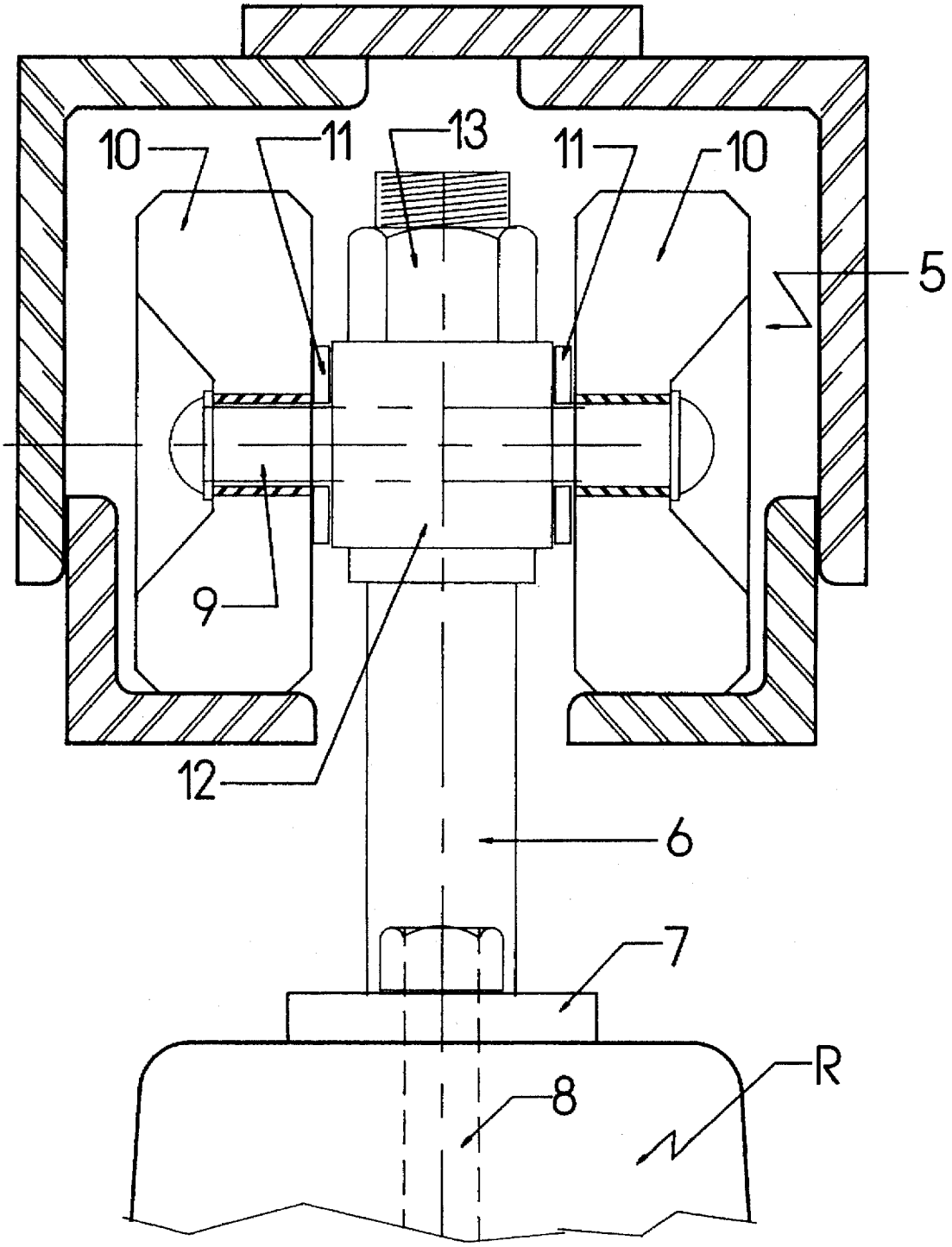
FIG. 3 is a section view of a road barrier in the guiding element of the invention.
Figure 4:
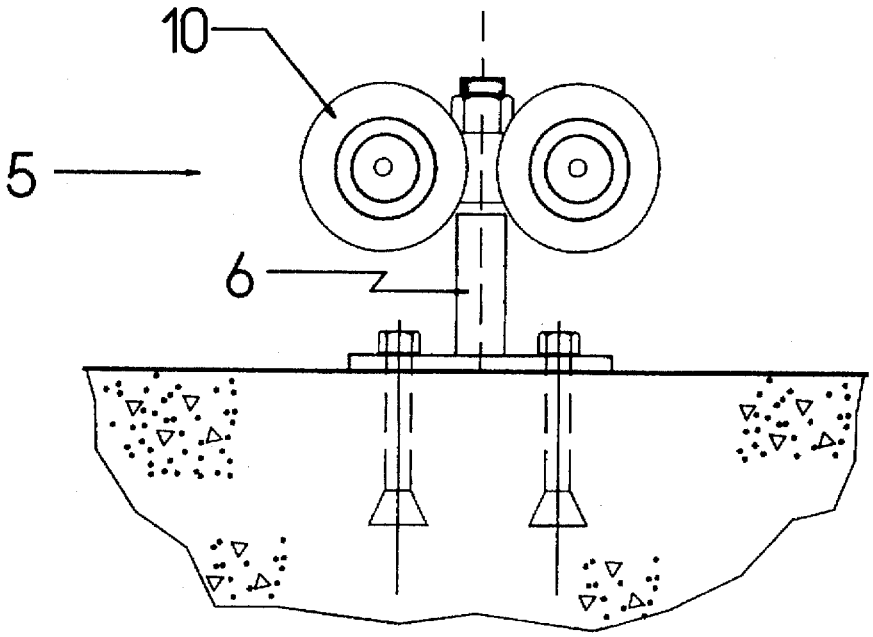
FIGS. 4 and 5 are a side view and an end view of the inventive road barrier of FIG. 3.
Figure 5:
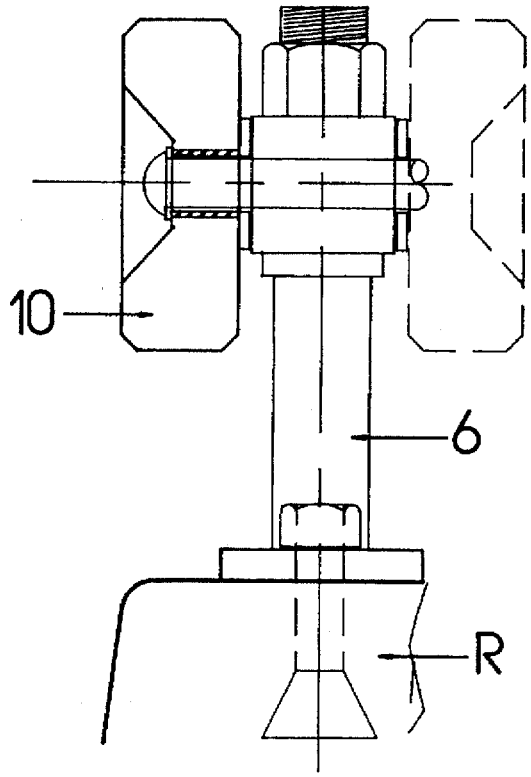

A device for transferring road elements in accordance with the present invention comprises guiding element which is identified as the whole in reference numeral 1. It is hollow and has a central curved part2 and two rectilinear end parts 3 and 4, each provided with a funnel. The guiding, element 1 is mountable on a vehicle which can be motorized as well as towed. The device is designed for transferring a wall, a partition, a barrier, etc. composed of a plurality of modular road elements R. The transfer of the road elements is performed by displacement of the guiding element 1 in direction of the arrow T so that the road elements are transferred from the location identified with reference numeral I to the line identified with reference numeral II. The guiding element is channel-shaped and open downwardly.

Figure 6:
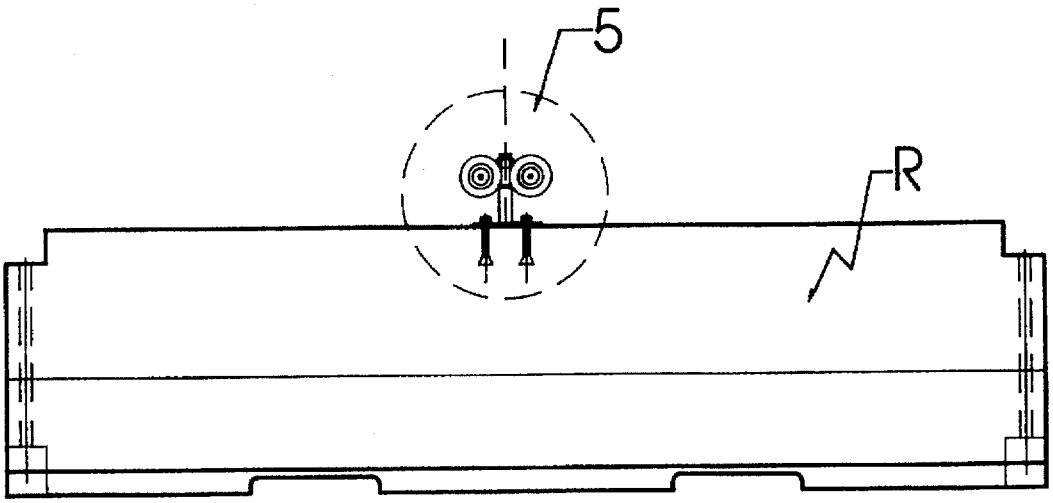
FIGS. 6 and 7 are a side view and an end view of a roller unit on the inventive road barrier on an enlarged scale.
Figure 7:
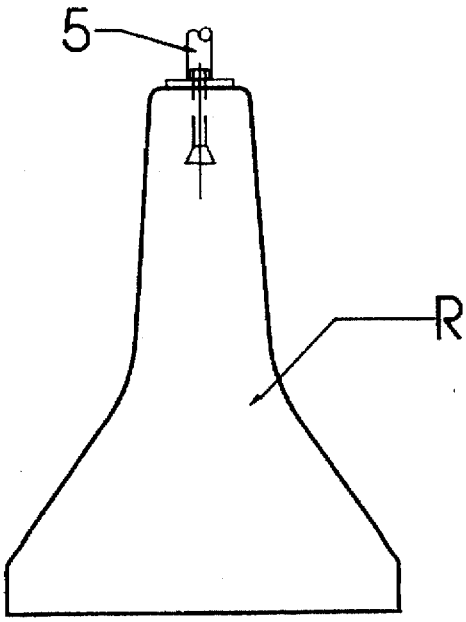

The inventive device further has a plurality of roller units which is identified as a whole with reference numeral 5. Each roller unit is mounted on the respective one of the road elements R substantially in the center of it or, in other words, in the middle between two opposite ends of the road element. Each roller unit has a substantially vertical steel bar 6 which is connected to the road element R by mounting plate 7, fixed to the road element by threaded bolts 8. The threaded bolt is screwed and mortared in the road element. A substantially horizontal axle identified with reference 9 is fixed to the bar 6 and carries at its both axle ends two wheels 10. Washers 11 are arranged between the central body 12 and the wheels 10, and a nut 13 is threaded on the other end of the bar 6. The axle is rotated and mounted in the body, as can be seen from FIGS. 6 and 7.

The end portions of the adjacent road elements R are pivotally connected with one another by connecting means which is identified as a whole reference numeral 14. The connecting means include two plates, which include an upper plate 15 and a lower plate 16. The plates ends are connected to the end portion of the road elements by pins 17 and fixed by nuts 18. The pins 17 are located turnably in corresponding vertical holes 19 provided in the end portions of the road elements. Thereby, the road elements can turn relative to one another in a horizontal plane.

The transfer of the road elements in accordance with the present invention is performed in the following manner:

The guiding element is fitted on the roller units 5 of several successive road elements and the guiding element is moved longitudinally. During this movement, the roller units of the road elements roll inside the guiding element 1 and the road elements R are displaced from one location to another location transversely to the guiding element.

The guiding element, as shown in FIG. 2, can be formed so that the one end portion 3 can be formed as an ascending portion while the other end portion 4 can be formed as a descending portion. In this construction when the road elements are moved from the end portion 3 through the central portion 2 through the end portion 4, the road elements are first lifted from the roadway surface, then transferred, and then placed again onto the roadway surface of the other location.

During the transfer of the road elements from one location to the other location, road elements can slightly turn relative to one another due to the pivotal connection of the end portions of the road elements by the connecting means 14.

In another advantageous feature of present invention, the bar 6 of the roller units 5 is formed so that when the road elements are placed on the roadway and an accident occurs, a car involved in the accident which can possibly hit roller units bends the steel bar 6, but it does not break it. If the steel bar were broken, the roller units could be disconnected from the road elements and fly in the air to cause damage and injury. This cannot happen in the rod elements in accordance with the present invention, since the steel bars 6 will just bend under the action of impact of a car involved in the accident. In order to achieve this object, the bars 6 are composed of a material which is bendable but not breakable, so that the bars can bend but do not break. For example, the bars can be composed of steel A 36.

Figure 8:
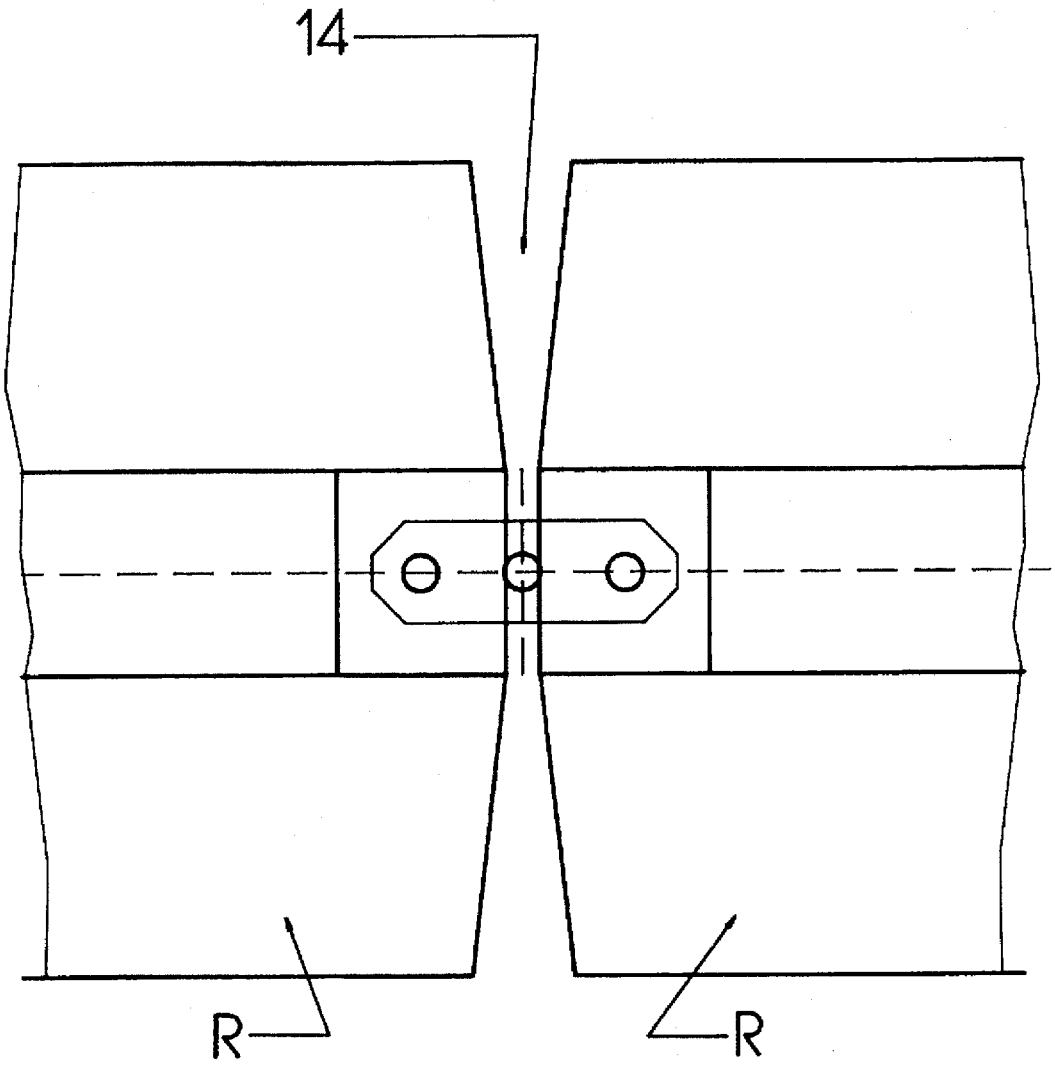
FIG. 8 is a top view of the barriers in accordance with the present invention which are connected with one another.
Figure 9:
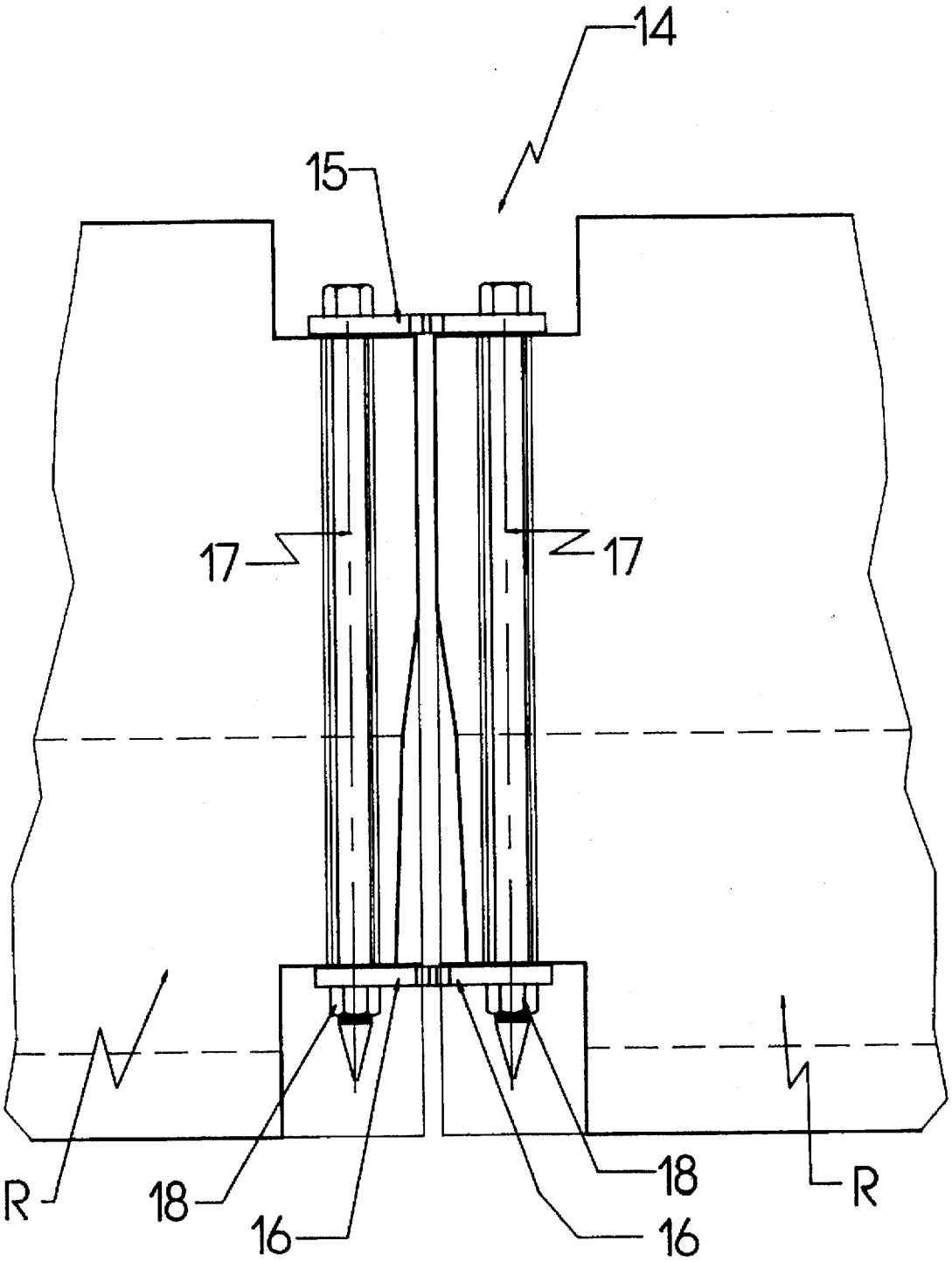
FIG. 9 is a side view of a connecting structure which connects the ends of two adjoining road barriers in accordance with the present invention.

As can be seen from FIG. 8, each end of the road element on the plan view has two surfaces inclined in opposite directions, so that during turning of the road elements in the process of transportation they can abut against one another. The central part between the inclined surfaces can be straight.

It is a very important feature of the invention that the road element are connected by the plates 15,16 which are pivotally connected to the adjacent plates in two pivot points (17) located at opposite sides of the line of separation between the adjacent road elements. As a result, during transfer the ends of the adjacent road elements can displace transversely relative to one another. Therefore the gap between the facing ends of the adjacent road elements can be very small.

While the invention has been illustrated and described as embodied in road elements, and method of and device for transferring same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for transferring a plurality of road elements, comprising a plurality of roller units with a single roller unit arranged on a respective one of the road elements substantially spaced from ends thereof; means for pivotally connecting end portions of adjacent ones of the road elements with one another; and a substantially channel-shaped guiding element having two opposite ends spaced from one another in a longitudinal direction and in a transverse direction, said guiding element being feedable over the roller units of the road elements and displaceable in the longitudinal direction so that the roller units are guidingly moved from one of the ends to the other of the ends of the guiding element and the road elements slightly pivot and are displaced from a location at one end of the guiding element to the location at another end of the guiding element, said connecting means including two connecting plates each having two opposite ends pivotally connected with an end portion of a respective one of the two adjacent road elements, one of said plates being an upper plate, while the other of said plates being a lower plate and said plates are spaced from one another in a vertical direction.

2. A device as defined in claim 1, wherein each of said roller units include a single substantially vertical bar mountable in each of the road elements, and at least one roller fixedly connected with said bar turnably about a substantially horizontal axis.

3. A device as defined in claim 2, wherein said single bar which is fixedly connected with said at least one roller is formed so that under the action of an object involved in an accident it bends but it does not break and therefore said at least one roller cannot be disconnected from said bar and fly in the air.

4. A transferable road structure, comprising a plurality of road elements; a single roller unit spaced from ends arranged on each of said road elements spaced from ends of the road element; and a connecting means for connecting said road elements with one another so that end portions of two adjacent ones of said road elements are connected with one another pivotally, each of said connecting means including two connecting plates each having two spaced ends pivotally connected with the end portions of two adjacent road elements, one of said plates being an upper plate while the other of said plates being a lower plate and said plates are spaced from one another in a vertical direction.

5. A transferable road structure as defined in claim 4, wherein each of said roller units has a single substantially vertical bar and at least one roller element fixedly connected with said bar turnably about substantially horizontal axis.

6. A transferable road structure as defined in claim 5, wherein said single bar which is fixedly connected with said at least one roller is formed so that under the action of an impact from an object involved in an accident it bends but it does not break and therefore said at least one roller cannot be disconnected from said bar and fly in the air.

7. A transferable road structure as defined in claim 4, wherein each of said road elements has two ends and is provided at each of said ends with two oppositely inclined surfaces, so that during pivoting of said road elements relative to one another they can abut against one another by said inclined surfaces.

8. A transferrable road structure as defined in claim 4, wherein said connecting means include at least one connecting element which connects two adjacent ones of said road elements with one another and is connected with said two adjacent road elements pivotally in two points located at opposite sides of a line of separation between said two adjacent road elements.

* * * * *